US008981889B2

(12) United States Patent
Yoo et al.

(10) Patent No.: US 8,981,889 B2
(45) Date of Patent: Mar. 17, 2015

(54) COMMON MODE FILTER WITH ESD PROTECTION PATTERN BUILT THEREIN

(71) Applicant: Samsung Electro-Mechanics Co., Ltd., Suwon-si, Gyeonggi-do (KR)

(72) Inventors: Young Seuck Yoo, Suwon-si (KR); Kang Heon Hur, Suwon-si (KP); Jun Hee Bae, Suwon-si (KR); Yong Suk Kim, Suwon-si (KR); Sang Moon Lee, Suwon-si (KR); Won Chul Sim, Suwon-si (KR); Young Do Kweon, Suwon-si (KR); Sung Kwon Wi, Suwon-si (KR)

(73) Assignee: Samsung Electro-Mechanics Co., Ltd., Gyeonggi-Do (KR)

( * ) Notice: Subject to any disclaimer, the term of this patent is extended or adjusted under 35 U.S.C. 154(b) by 5 days.

(21) Appl. No.: 13/831,620

(22) Filed: Mar. 15, 2013

(65) Prior Publication Data

US 2014/0062637 A1 Mar. 6, 2014

(30) Foreign Application Priority Data

Aug. 29, 2012 (KR) ..... 10-2012-0094776

(51) Int. Cl.

| | |
|---|---|
| ***H01F 17/00*** | (2006.01) |
| ***H01F 5/00*** | (2006.01) |
| ***H01F 27/28*** | (2006.01) |
| ***H01F 27/24*** | (2006.01) |
| ***H01F 27/40*** | (2006.01) |

(52) U.S. Cl.

CPC ..... *H01F 27/40* (2013.01); *H01F 17/0013* (2013.01); *H01F 2017/0026* (2013.01); *H01F 2017/0066* (2013.01)

USPC ..... 336/105; 336/199; 336/200; 336/230; 336/232; 336/234

(58) Field of Classification Search

USPC ..... 336/105, 199, 200, 232

See application file for complete search history.

(56) References Cited

U.S. PATENT DOCUMENTS

| | | | | |
|---|---|---|---|---|
| 2004/0075521 | A1* | 4/2004 | Yu et al. | 336/200 |
| 2007/0069844 | A1* | 3/2007 | Kudo et al. | 336/83 |
| 2007/0205856 | A1* | 9/2007 | Matsunaga et al. | 336/200 |
| 2008/0197963 | A1* | 8/2008 | Muto | 336/200 |
| 2011/0007439 | A1* | 1/2011 | Asakawa et al. | 361/56 |

FOREIGN PATENT DOCUMENTS

| | | | |
|---|---|---|---|
| JP | 2011-181512 | | 9/2011 |
| JP | 2011-181512 | A * | 9/2011 |
| KR | 10-2008-0092155 | | 10/2008 |

* cited by examiner

*Primary Examiner* — Elvin G Enad
*Assistant Examiner* — Kazi Hossain
(74) *Attorney, Agent, or Firm* — Bracewell & Giuliani LLP; Brad Y. Chin

(57) ABSTRACT

Disclosed herein is a common mode filter with an ESD protection pattern built therein. The common mode filter includes a base substrate that is made of an insulating material, a first insulating layer that is formed on the base substrate, a coil-shaped internal electrode that is formed on the first insulating layer, a second insulating layer that is formed on the internal electrode, a first external electrode terminal that is formed on the second insulating layer, a first ferrite resin layer that is formed on the second insulating layer and receives the first external electrode terminal, an ESD protection pattern that is formed on the first external electrode terminal, a second external electrode terminal that is formed on the ESD protection pattern, and a second ferrite resin layer that is formed on the first ferrite resin layer and receives the second external electrode terminal.

8 Claims, 5 Drawing Sheets

COMMON MODE FILTER WITH ESD PROTECTION PATTERN BUILT THEREIN

CROSS REFERENCE(S) TO RELATED APPLICATIONS

This application claims the benefit under 35 U.S.C. Section 119 of Korean Patent Application Serial No. 10-2012-0094776, entitled "Common Mode Filter with ESD Protection Pattern Built Therein" filed on Aug. 29, 2012, which is hereby incorporated by reference in its entirety into this application.

BACKGROUND OF THE INVENTION

1. Technical Field

The present invention relates to a common mode filter with a electrostatic discharge (ESD) protection pattern built therein, and more particularly, to a common mode filter with an ESD protection pattern built therein, in which an external electrode terminal of the common mode filter is divided into a first external electrode terminal and a second external electrode terminal, and the ESD protection pattern is built therebetween so that a function of the common mode filter and a static eliminating function are integrated into a single electronic component to be implemented, and therefore a mounting area is reduced at the time of application of an SET product.

2. Description of the Related Art

In recent years, electronic apparatuses such as mobile phones, home appliances, personal computers (PC), personal digital assistants (PDA), liquid crystal displays (LCD), navigations, and the like have been gradually digitalized with faster speeds. Since the electronic apparatuses are sensitive to external stimulation, there occurs a case in which the circuits are damaged or signals are distorted when slightly abnormal voltage and high frequency noise flow into an internal circuit of the electronic apparatus from the outside.

As the causes of the abnormal voltage and the noise, a switching voltage generated in the circuit, a power source noise included in a power supply voltage, unnecessary electromagnetic signals or noises, or the like may be given, and as a means for preventing the abnormal voltage and the high frequency noise from flowing into the circuit, a filter may be used.

In a general differential signal transmission system, together with a common mode noise filter for removing common mode noises, a passive component such as a diode, a varistor, or the like has to be separately used to prevent electro static discharge (Hereinafter, referred to as "ESD") that may occur in an input/output terminal.

In this manner, when the separate passive component is used in the input/output terminal so as to correspond to the ESD, a mounting area and manufacturing costs may be increased, and distortion of signals may occur.

For example, in order to suppress the ESD using the varistor, internal electronic components of the electronic apparatus are protected in such a manner that an end of the varistor is connected to the input/output terminal and the other end thereof is connected to a ground terminal.

However, the varistor acts as a capacitor in a normal operation state of the electronic apparatus to which a transient voltage is not applied. Since the capacitor has a capacitance value that changes at a high frequency, there occurs a problem such as occurrence of signal distortion, or the like when an element of the varistor is used in a data input/output terminal at a high frequency or a high speed, or the like.

Meanwhile, a protection element such as the common mode noise filter, the varistor, or the like may be formed in a rectangular parallelepiped shape, and an internal electrode may be provided inside the protection element, and an external electrode that is connected with the internal electrode may be provided outside the protection element.

In addition, a ground electrode may be provided inside the protection element, and another external electrode that is connected with the ground electrode may be provided outside the protection element.

However, the external electrode that is connected with the internal electrode is provided on one side and the other side of the element, and the external electrode that is connected with the ground electrode is provided on a side surface of the element in a direction that intersects with the one side and the other side of the element.

That is, the external electrode that is connected with the internal electrode and the external electrode that is connected with the ground electrode are formed respectively on mutually different side surfaces.

Accordingly, the external electrode is formed on all side surfaces of the element. In addition, in order to mount the element on a printed circuit board, a space for connecting the external electrode and a wiring printed on the printed circuit board is required.

However, in a structure of the element according to the related art in which the external electrode is provided on all side surfaces of the element, there is a limitation in securing a spare space of the printed circuit board, and therefore design of the printed circuit board is difficult.

SUMMARY OF THE INVENTION

An object of the present invention is to provide a common mode filter with an ESD protection pattern built therein, in which an external electrode terminal of the common mode filter is divided into a first external electrode terminal and a second external electrode terminal, and the ESD protection pattern is built therebetween so that a function of the common mode filter and a static eliminating function are integrated into a single electronic component to be implemented, and therefore a mounting area is reduced at the time of application of an SET product.

According to an exemplary embodiment of the present invention, there is provided a common mode filter with an electrostatic discharge (ESD) protection pattern built therein, being characterized in that an external electrode terminal of the common mode filter is divided into a first external electrode terminal and a second external electrode terminal, and an ESD protection pattern is built between the first and second external electrode terminals so that a function of the common mode filter and a static eliminating function are integrated into one electronic component.

According to another exemplary embodiment of the present invention, there is provided a common mode filter with an ESD protection pattern built therein, including: a base substrate that is made of an insulating material; a first insulating layer that is formed on the base substrate; a coil-shaped internal electrode that is formed on the first insulating layer; a second insulating layer that is formed on the internal electrode; a first external electrode terminal that is formed on the second insulating layer; a first ferrite resin layer that is formed on the second insulating layer and receives the first external electrode terminal; an ESD protection pattern that is formed on the first external electrode terminal; a second external electrode terminal that is formed on the ESD protection pattern; and a second ferrite resin layer that is formed on the first ferrite resin layer and receives the second external electrode terminal.

In addition, the base substrate may be made of ferrite.

Besides, the first and second insulating layers may be made of any one selected from polyimide, epoxy resin, benzo cyclobutene (BCB), and other high-molecular polymers.

Further, the internal electrode may have a multi-layered structure of which a plurality of layers are spaced apart from each other by a predetermined interval.

Furthermore, a portion in which the ESD protection pattern of the first external electrode terminal is formed may be formed as concavo-convex shape, or branched into a plurality of branch lines, and a plurality of ESD protection patterns may be formed to correspond one-to-one to each of the plurality of branch lines.

Moreover, the ESD protection pattern may be a printed pattern.

Also, the ESD protection pattern may be made of a material in which at least one conductive material selected from ruthenium oxide ($RuO_2$), platinum (Pt), palladium (Pd), antigen (Ag), aurum (Au), nickel (Ni), chromium (Cr), tungsten (W), and the like is mixed in an organic material.

DESCRIPTION OF THE PREFERRED EMBODIMENTS

Hereinafter, details with respect to a preferred embodiment of the present invention will be described with reference to the accompanying drawings as below.

Figure 1:
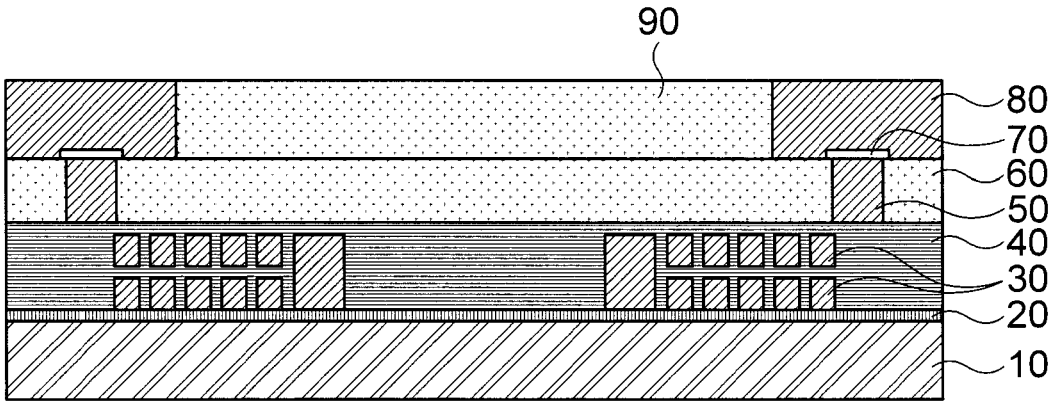
FIG. 1 is a conceptual diagram showing a cross-sectional structure of a common mode filter with an electrostatic discharge (ESD) protection pattern built therein according to an embodiment of the present invention.

FIG. 1 is a conceptual diagram showing a cross-sectional structure of a common mode filter with an electrostatic discharge (ESD) protection pattern built therein according to an embodiment of the present invention, and FIGS. 2A to 2F are conceptual diagrams sequentially showing a process of manufacturing the common mode filter with an ESD protection pattern built therein according to an embodiment of the present invention.

Referring to FIGS. 1 and 2, the common mode filter with an ESD protection pattern built therein according to an embodiment of the present invention includes a base substrate 10, a first insulating layer 20, an internal electrode 30, a second insulating layer 40, a first external electrode terminal 50, an ESD protection pattern 70, a first ferrite resin layer 60, a second external electrode terminal 80, and a second ferrite resin layer 90.

Figure 2A:
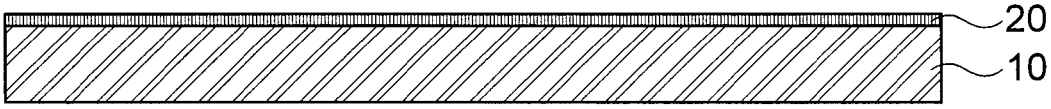
FIGS. 2A to 2F are conceptual diagrams sequentially showing a process of manufacturing a common mode filter with an ESD protection pattern built therein according to an embodiment of the present invention.

As shown in FIG. 2A, the first insulating layer 20 is formed on the base substrate 10.

In this instance, the base substrate 10 may be manufactured using an insulating material, and, for example, a ferrite material may be used.

In addition, the first insulating layer 20 may select and use one of polyimide, epoxy resin, benzo cyclobutene (BCB), or other high-molecular polymers, and may adjust an impedance by adjusting a thickness of a spin coating layer.

Figure 2B:
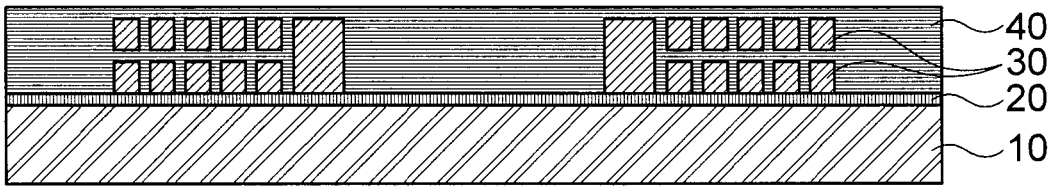

In addition, the internal electrode 30 and the second insulating layer 40 are formed on the first insulating layer 20, as shown in FIG. 2B.

Figure 3:
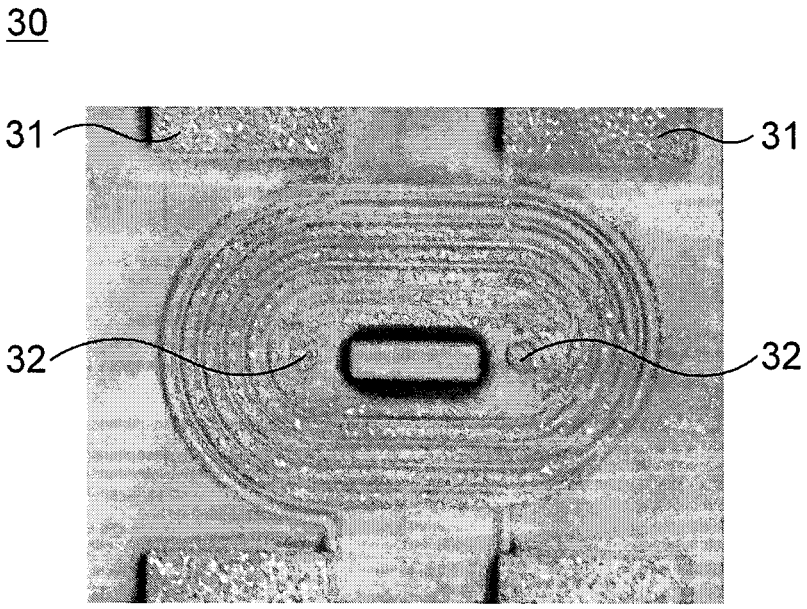
FIG. 3 is a photograph showing a structure of an internal electrode according to an embodiment of the present invention.

In this instance, the internal electrode 30 may be formed into a coil shape, as shown in FIG. 3, and an end of the coil shape forms a drawing end 31 that is connected to the external electrode terminal side, and the other end thereof forms a connection end 32 that grounds between a plurality of internal electrodes 30.

In addition, the second insulating layer 40 may select and use one of polyimide, epoxy resin, benzo cyclobutene (BCB), or other high-molecular polymers, and may be formed by a photo-via method.

Here, the photo-via method refers to a method in which a special developing ink containing insulating resin is used as an insulating layer and is laminated.

In this instance, the internal electrode 30 may have a multi-layered structure in which a plurality of layers are spaced apart from each other by a predetermined interval, and a second insulating layer 40 is formed so as to completely receive the internal electrode 30.

Figure 2C:
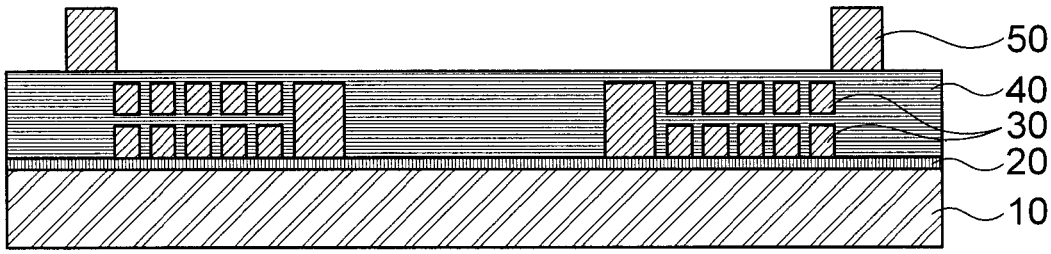

In addition, as shown in FIG. 2C, the first external electrode terminal 50 is formed on the second insulating layer 40. In this instance, the first external electrode terminal 50 is connected to the drawing end 31 of the internal electrode 30 shown in FIG. 3, and referring to FIGS. 3 and 4, the first external electrode terminals 50 that are connected to each drawing end 31 are disposed one by one at four edges in four directions.

Figure 2D:
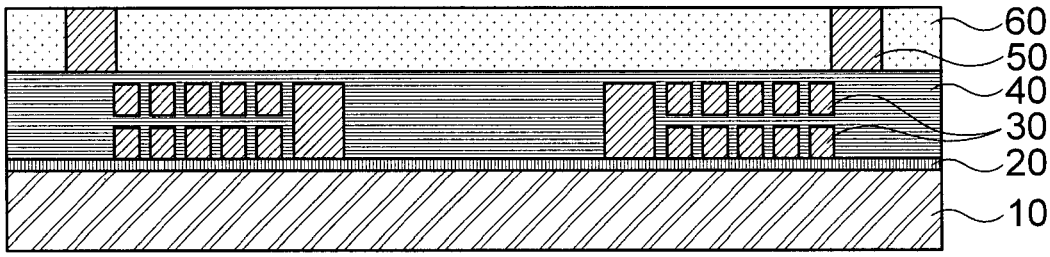

In addition, as shown in FIG. 2D, the first external electrode terminal 50 protrudes by a predetermined height, and the first ferrite resin layer 60 is formed in accordance with the height of the protruding first external electrode terminal 50. In addition, the first ferrite resin layer 60 is formed on the second insulating layer 40 and receives the first external electrode terminal 50.

Figure 2E:
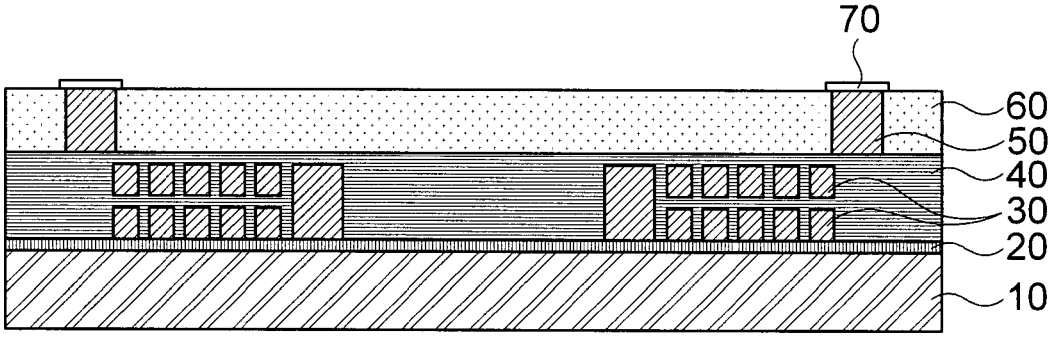

In addition, as shown in FIG. 2E, the ESD protection pattern 70 is formed on the first external electrode terminal 50.

In this instance, the ESD protection pattern 70 may be made of a material in which at least one conductive material selected from titanium dioxide ($TiO_2$), ruthenium oxide ($RuO_2$), platinum (Pt), palladium (Pd), antigen (Ag), aurum (Au), nickel (Ni), chromium (Cr), tungsten (W), and the like is mixed in an organic material.

The ESD protection pattern 70 according to an embodiment of the present invention described above forms a pattern in a printing method, and this has an effect that improves the following problem in the existing method.

For example, adhesion of titanium dioxide ($TiO_2$) should be gained sufficiently in order to form the ESD protection pattern (for example, ($TiO_2$) on an electrode terminal (for example, copper (Cu)) in the existing method, and for achieving this, a process for increasing adhesion between the electrode terminal (Cu) and the ESD protection pattern ($TiO_2$) as well as adhesion between the ESD protection pattern ($TiO_2$)

and the ferrite resin should precede, and when the adhesion does not increase, a problem occurs in that the ESD protection pattern ($TiO_2$) peels off during the process.

To overcome this problem, a surface treatment process using a plasma cleaning method (plasma activation) should be performed in the existing method, thereby simultaneously increasing the adhesion of the ferrite resin layer 60 and electrode terminal (Cu) layer.

In addition, in the existing method, the ESD protection pattern ($TiO_2$) is formed through etching, but a patterning operation by etching is difficult, and the use of an etching solution is restricted.

In this instance, the etching is performed using the etching solution in which a small amount of phosphoric acid or sulfuric acid is mixed. Here, when the amount of phosphoric acid or sulfuric acid is excessively mixed, a problem occurs in that a magnetic material of the ferrite resin layer 60 is damaged.

In addition, in order to repeatedly form the external electrode on the patterned ESD protection pattern ($TiO_2$), the plasma cleaning method should be performed so as to increase the adhesion.

In addition, in the existing method, there is a problem in that the ferrite resin that does not react to a plating solution should be used so that the ferrite resin layer is prevented from contacting the plating solution and reacting to the plating solution at the time of plating of the external electrode.

Figure 4:
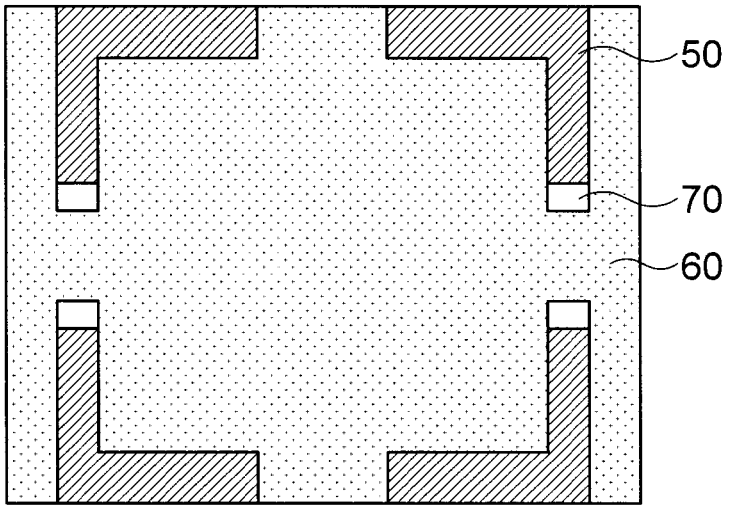
FIG. 4 is a plan view showing a first external electrode terminal and an ESD protection pattern according to an embodiment of the present invention.

FIG. 4 is a plan view showing a first external electrode terminal and an ESD protection pattern according to an embodiment of the present invention. Referring to FIG. 4, the ESD protection pattern 70 is respectively printed on both end portions of the first external electrode terminals 50 of which each pair is disposed so as to face each other.

Figure 2F:
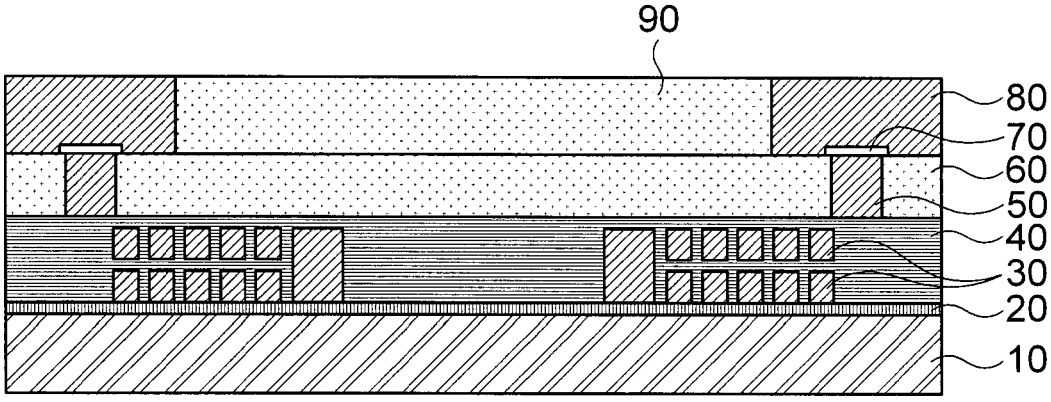

As shown in FIG. 2F, the second external electrode terminal 80 and the second ferrite resin layer 90 may be sequentially formed.

Figure 5:
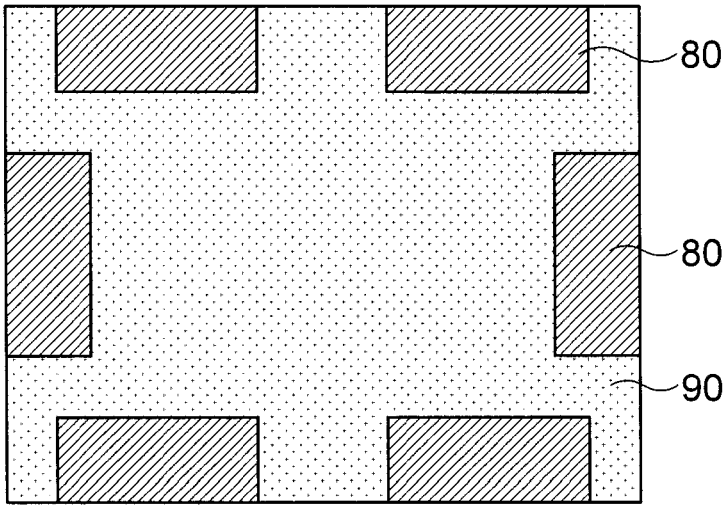
FIG. 5 is a plan view showing a second external electrode terminal according to the present embodiment of the present invention.

FIG. 5 is a plan view showing a second external electrode terminal according to an embodiment of the present invention.

Referring to FIG. 5, each of a plurality of second external electrode terminals 80 is respectively formed, and on the ESD protection pattern 70 and the first external electrode terminal 50, and in this instance, the second external electrode terminal 80 formed on the ESD protection pattern 70 is formed by connecting each pair of the ESD protection patterns 70.

Figure 6:
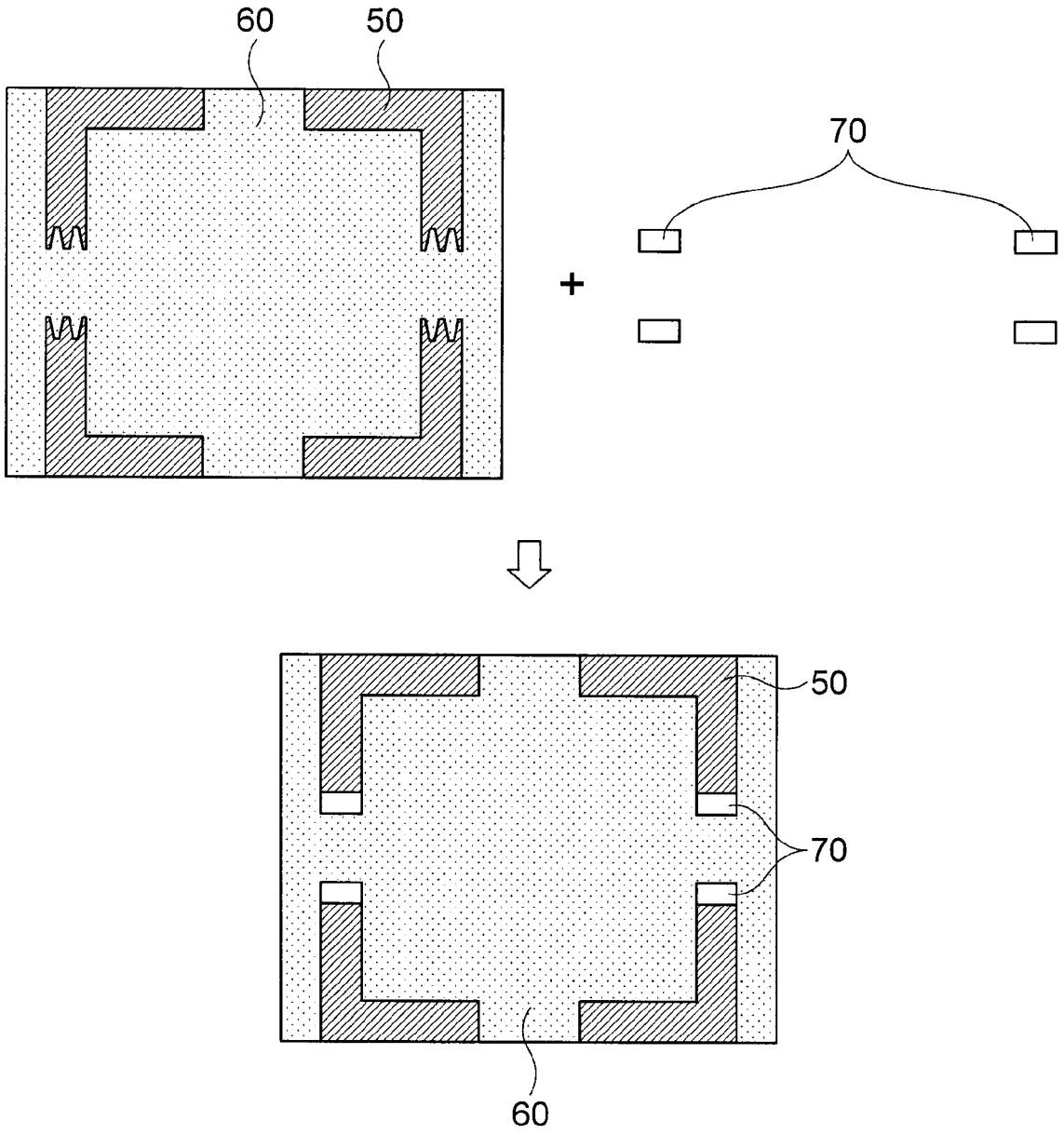
FIGS. 6 and 7 are conceptual diagrams showing a modified example of the first external electrode terminal and the ESD protection pattern according to an embodiment of the present invention.
Figure 7:
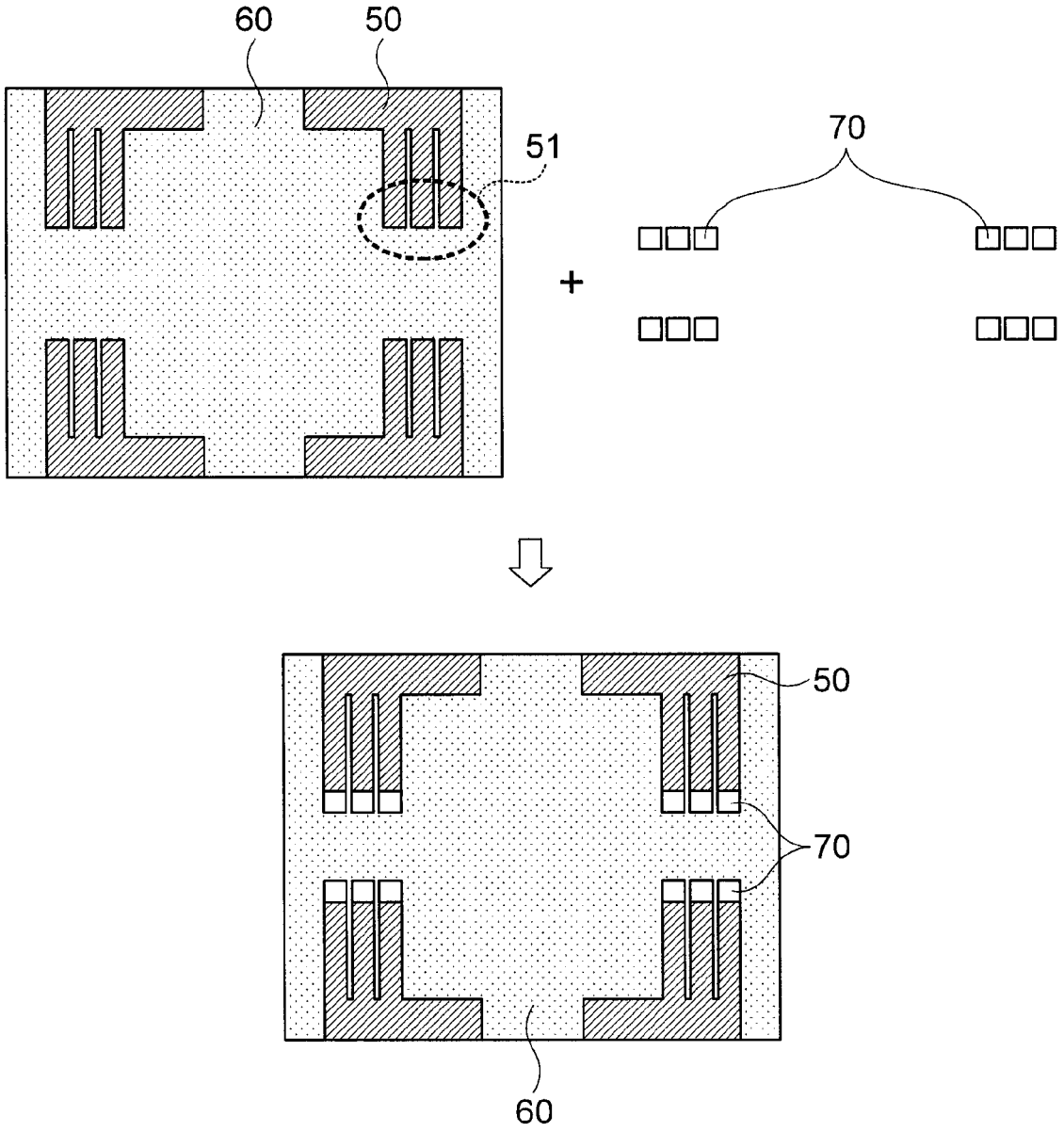

FIGS. 6 and 7 are conceptual diagrams showing a modified example of a first external electrode terminal and an ESD protection pattern according to an embodiment of the present invention. A portion in which the ESD protection pattern 70 of the first external electrode terminal 50 is formed may be formed as a concavo-convex 51 shape or branched into a plurality of branch lines 52.

In this instance, the concavo-convex 51 shape may be shaped in a sharp waveform, and the number of the branch lines 52 may be determined in a range of 2 to 6.

In this instance, when the plurality of branch lines 52 are formed, a plurality of ESD protection patterns 70 may be formed to correspond one-to-one with each of the branch lines 52.

Therefore, a grounding surface area between the first external electrode terminal 50 and the ESD protection pattern 70 is increased, thereby further improving an electrostatic discharging function.

In addition, the second ferrite resin layer 90 in which the second external electrode terminals 80 is received is formed on the first ferrite resin layer 60.

In this instance, the first and second ferrite resin layers 60 and 90 are formed into a single layer, but are separately formed in two stages, so that the ESD protection pattern 70 is built between the first and second external electrode terminals.

As described above, according to the embodiments of the present invention, the external electrode terminal of the common mode filter is divided into the first external electrode terminal and the second external electrode terminal, and the ESD protection pattern is built therebetween so that a function of the common mode filter and a static eliminating function are integrated into a single electronic component to be implemented, and therefore a mounting area is reduced at the time of application of an SET product, thereby contributing to miniaturization of the product.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Therefore, the detailed description of the present invention does not intend to limit the present invention to the disclosed embodiments. Further, it should be appreciated that the appended claims may include even another embodiment.

What is claimed is:

1. A common mode filter with an electrostatic discharge (ESD) protection pattern built therein, the common mode filter comprising:

an external electrode terminal divided into a plurality of first external electrode terminals and a plurality of second external electrode terminals; and an ESD protection pattern arranged between the plurality of first and second external electrode terminals, so that a function of the common mode filter and a static eliminating function are integrated into one electronic component, wherein the ESD protection pattern is formed on both ends of each of the plurality of first external electrode terminals, wherein the ends of the plurality of first external electrode terminals are arranged to face one other, and wherein a respective second external electrode terminal is formed on a respective ESD protection pattern.

2. A common mode filter with an ESD protection pattern built therein, the common mode filter comprising:

a base substrate made of an insulating material;

a first insulating layer formed on the base substrate;

a coil-shaped internal electrode formed on the first insulating layer;

a second insulating layer formed on the internal electrode;

a plurality of first external electrode terminals formed on the second insulating layer;

a first ferrite resin layer formed on the second insulating layer and configured to receive the plurality of first external electrode terminals;

an ESD protection pattern formed on both ends of each of the plurality of first external electrode terminals, wherein the ends of the plurality of first external electrode terminals are arranged to face one other;

a plurality of second external electrode terminals, wherein a respective second external electrode terminal is formed on a respective ESD protection pattern; and a second ferrite resin layer formed on the first ferrite resin layer and configured to receive the plurality of second external electrode terminals.

3. The common mode filter according to claim 2, wherein the base substrate is made of ferrite.

4. The common mode filter according to claim 2, wherein the first and second insulating layers are made of any one selected from the group consisting of polyimide, epoxy resin, benzo cyclobutene (BCB), and other high-molecular polymers.

5. The common mode filter according to claim 2, wherein the internal electrode comprises a multi-layered structure of which layers are spaced apart from each other by a predetermined interval.

6. The common mode filter according to one of claims 1 and 2, wherein a portion in which the ESD protection pattern of the first external electrode terminal is formed is formed as a concavoconvex shape, or branched into a plurality of branch lines, and wherein a plurality of ESD protection patterns are formed to correspond one-to-one to each of the plurality of branch lines.

7. The common mode filter according to one of claims 1 to 6, wherein the ESD protection pattern is a printed pattern.

8. The common mode filter according to one of claims 1 to 6, wherein the ESD protection pattern is made of a material in which at least one conductive material is selected from the group consisting of ruthenium oxide ($RuO_2$), platinum (Pt), palladium (Pd), antigen (Ag), aurum (Au), nickel (Ni), chromium (Cr), tungsten (W), and the like is mixed in an organic material.

* * * * *